US008783982B2

(12) United States Patent
Ushiyama

(10) Patent No.: US 8,783,982 B2
(45) Date of Patent: Jul. 22, 2014

(54) MEDIA PROCESSING DEVICE, CONTROL METHOD FOR A MEDIA PROCESSING DEVICE, AND RECORDING MEDIUM

(75) Inventor: Yoshiki Ushiyama, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 356 days.

(21) Appl. No.: 13/234,850

(22) Filed: Sep. 16, 2011

(65) Prior Publication Data

US 2012/0070219 A1 Mar. 22, 2012

(30) Foreign Application Priority Data

Sep. 17, 2010 (JP) ..... 2010-209213

(51) Int. Cl.

| | |
|---|---|
| ***B41J 19/18*** | (2006.01) |
| ***B41J 3/60*** | (2006.01) |
| ***B41J 29/38*** | (2006.01) |
| ***B41J 19/20*** | (2006.01) |

(52) U.S. Cl.

CPC ..... *B41J 19/207* (2013.01); *B41J 19/205* (2013.01); *B41J 29/38* (2013.01); *B41J 3/60* (2013.01)

USPC ..... 400/355; 400/149; 400/188; 400/283; 400/605; 400/607; 400/607.2; 347/37

(58) Field of Classification Search

USPC ..... 347/37; 400/352, 354, 355, 283, 605, 400/607, 607.2, 188, 149

See application file for complete search history.

(56) References Cited

U.S. PATENT DOCUMENTS

| | | | | | |
|---|---|---|---|---|---|
| 4,789,874 | A | * | 12/1988 | Majette et al. | 347/37 |
| 5,615,959 | A | | 4/1997 | Nishizawa et al. | |
| 5,628,572 | A | * | 5/1997 | Sato et al. | 400/322 |
| 5,670,995 | A | * | 9/1997 | Kupcho et al. | 347/5 |
| 7,810,901 | B2 | * | 10/2010 | Akiyama | 347/37 |
| 2006/0115312 | A1 | * | 6/2006 | Furihata et al. | 400/149 |
| 2010/0073737 | A1 | | 3/2010 | Honda et al. | |

FOREIGN PATENT DOCUMENTS

| | | | | | |
|---|---|---|---|---|---|
| JP | 63162258 | A | * | 7/1988 | B41J 19/18 |
| JP | 05-069626 | A | | 3/1993 | |
| JP | 7329389 | A | | 12/1995 | |
| JP | 08002049 | A | * | 1/1996 | B41J 19/18 |
| JP | 09226201 | A | * | 9/1997 | B41J 19/18 |
| JP | 2002-347228 | A | | 12/2002 | |
| JP | 2010074603 | A | | 4/2010 | |

* cited by examiner

*Primary Examiner* — Daniel J Colilla

(74) *Attorney, Agent, or Firm* — Lowe Hauptman & Ham, LLP

(57) ABSTRACT

A media processing device and control method for a media processing device enable accurately setting and detecting the home position of a carriage without using a dedicated sensor. Scales 56, 62 having a plurality of wide slits 65 formed at equal intervals and a narrow slit 66 at one end 56A, 62A are disposed parallel to carriage shafts 53, 60. Carriage sensors 55, 61 scan the scales 56, 62 while the carriages 52, 58 move bidirectionally, and detect the wide slits 65 and the narrow slits 66. To initialize the carriages 52, 58, the carriages 52, 58 are moved specific distance L away from the one end 56A, 62A, and the carriages 52, 58 are then reversed and moved until the carriage sensors 55, 61 detect the narrow slits 66. The home position HP is set based on where the narrow slit 66 is detected.

14 Claims, 7 Drawing Sheets

MEDIA PROCESSING DEVICE, CONTROL METHOD FOR A MEDIA PROCESSING DEVICE, AND RECORDING MEDIUM

This application claims priority under 35 U.S.C. §119 to Japanese Patent Application No. 2010-209213 filed on Sep. 17, 2010, the entire disclosure of which is expressly incorporated by reference herein.

BACKGROUND

1. Technical Field

The present invention relates to a media processing device that records on a recording medium, a control method for the media processing device, and a recording medium.

2. Related Art

Media processing devices that have a carriage disposed freely slidably on a carriage shaft, a drive motor that moves the carriage along the carriage shaft, and a recording head carried on the carriage, and record on a recording medium by this recording head, are known from the literature. In order to accurately record to a specified position on the recording medium with such a media processing device, Japanese Unexamined Patent Appl. Pub. JP-A-H07-329389 teaches using a carriage position sensor that detects the carriage position, and a home position sensor that detects the home position of the carriage.

A problem with this configuration of the related art is that because dedicated sensors are used for carriage position detection and home position detection, the number of sensors used in the media processing device increases and cost increases accordingly.

This is particularly a problem when two carriages are used to record on both the front and back sides of the recording medium because the number of sensors increases even more.

SUMMARY

A media processing device and a control method for a media processing device according to the invention enable accurately detecting the carriage position and the home position without using dedicated sensors.

A first aspect of the invention is a media processing device including a conveyance path that conveys a recording medium; on one side of the conveyance path a first recording head that records on one side of the recording medium, a first carriage that carries the first recording head, a first conveyance unit that moves the first carriage on a first carriage shaft, a first scale having a plurality of first slits of a specific width formed with a specific interval therebetween, and at one end thereof a second slit of a different width than the first slit, and a first detection unit that is carried on the first carriage and detects the first slits and the second slit of the first scale; and on the other side of the conveyance path a second recording head that records on the other side of the recording medium, a second carriage that carries the second recording head, a second conveyance unit that moves the second carriage on a second carriage shaft, a second scale having a plurality of third slits of a specific width formed with a specific interval therebetween, and at one end thereof a fourth slit of a different width than the third slit, and a second detection unit that is carried on the second carriage and detects the third slits and the fourth slit of the second scale. The first scale and the second scale are disposed so that the end of the first scale to which the second slit is disposed, and the end of the second scale to which the fourth slit is disposed, are at the same end on opposite sides of the conveyance path.

This aspect of the invention forms a second slit of a different width than the first slits at one end of the first slits, and enables knowing the position of the first carriage and the location of the home position based on the first slits and the position of the second slit at the one end detected by the first detector carried on the first carriage. In addition, because the position of the first carriage and the home position can be detected using a simple configuration, these positions can be accurately detected without providing multiple dedicated sensors.

Furthermore, by providing a first carriage and a second carriage on opposite sides of the conveyance path, the front and back sides of the recording medium can be recorded.

In addition, because the first scale and the second scale are disposed so that the second slit and the fourth slit are on the same end on opposite sides of the conveyance path, recording both sides of the recording medium from the same end of the paper can start easily referenced to the positions of the second slit and the fourth slit. More specifically, when printing on both the front and back sides of the recording medium, starting printing both sides referenced to the same end of the recording paper can be done easily.

A media processing device according to another aspect of the invention preferably also has a control unit that drives the first conveyance unit and moves the first carriage a first specific distance away from the one end of the first scale, reverses and moves the first carriage at least until the first detection unit detects the second slit, and sets the first carriage home position based on the position where the second slit was detected, and drives the second conveyance unit and moves the second carriage a second specific distance away from the one end of the second scale, reverses and moves the second carriage at least until the second detection unit detects the fourth slit, and sets the second carriage home position based on the position where the fourth slit was detected.

Because the configuration used on the first carriage side is duplicated on the second carriage side, the number of sensors can be reduced, and the home position of each carriage can be accurately detected without using a dedicated sensor on either side.

Furthermore, because the home position of each carriage on opposite sides of the conveyance path can be set to the same side of the media processing device, the start-printing positions of the front and back sides of the recording medium can both be aligned to the left side of the recording medium, for example, the positions where printing starts on the front and back sides can be easily aligned, and print quality can be increased by a simple construction. In addition, by setting the home positions on the same side of the media processing device, the size of the printing range (recording range) relative to the device width can be increased compared with a configuration in which the home positions are on opposite sides of the device.

Furthermore, the home position can be set and detected accurately and reliably no matter where the first carriage is located because the first carriage is first moved a specific distance away from the one end of the first scale, and the first carriage is then reversed and the second slit detected. The same operation can be performed on the second carriage side.

In a media processing device according to another aspect of the invention, the first conveyance unit has a first stepper motor, and the control unit detects conveyance errors of the first conveyance unit based on a first number of steps the first stepper motor was driven, and the distance the first carriage moved, which is obtained based on detection of first slits by the first detection unit. The second conveyance unit similarly has a second stepper motor, and the control unit detects conveyance errors of the second conveyance unit based on a second number of steps the second stepper motor was driven, and the distance the second carriage moved, which is obtained based on detection of third slits by the second detection unit.

This aspect of the invention can detect conveyance errors including loss of synchronization, such as when a stepper motor does not move even though it was driven a specific number of steps, and can simplify the construction used to detect conveyance errors, by using respective scales and detection units for detecting the positions of the respective carriages.

In a media processing device according to another aspect of the invention, the control unit does not detect conveyance errors when the first carriage or second carriage accelerates or decelerates.

This aspect of the invention can prevent erroneously detecting a loss of synchronization, for example, due to the effect of stepper motor rotation vibrating during carriage acceleration or deceleration, and can accurately control the carriage position.

In a media processing device according to another aspect of the invention, the first slits of the first scale and the third slits of the second scale are the same width; and the second slit of the first scale and the fourth slit of the second scale are the same width.

This aspect of the invention enables using identical scales for the first scale and second scale, and enables rendering the device without increasing the parts count.

Further preferably, the control unit supplies power to the detection units only when the conveyance units move. This aspect of the invention turns off power supply to the detection units when the conveyance units are stopped, thereby reduces power consumption in the standby mode, and saves energy.

Another aspect of the invention is a control method for the media processing device described above, and includes steps of: moving the first carriage a first specific distance away from the one end of the first scale, reversing and moving the first carriage at least until the first detection unit detects the second slit, and setting the first carriage home position based on the position where the second slit was detected, by the first conveyance unit; and moving the second carriage a second specific distance away from the one end of the second scale, reversing and moving the second carriage at least until the second detection unit detects the fourth slit, and setting the second carriage home position based on the position where the fourth slit was detected, by the second conveyance unit.

Even if the first carriage is stopped near the home position when initialization starts, the detection unit according to this aspect of the invention can always detect a first slit of a different width before detecting the second slit by moving the carriage from this position in the direction away from the second slit a distance greater than the sum of the first slit width, second slit width, and the gap between the first slit and second slit, and then moving the carriage until the second slit is detected. Because the first slit and second slit can thus be detected in this order, the home position can be detected based on detection of the second slit. Home position detection errors can therefore be prevented, and the position of the home position can be accurately set and detected. The same operation is possible on the second carriage side.

Another aspect of the invention is a control method for a media processing device that has a carriage disposed freely slidably on a carriage shaft, a conveyance unit that moves the carriage bidirectionally on the carriage shaft, and a recording head carried on the carriage, and records on a recording medium conveyed through the conveyance path by the recording head. The media processing device has a scale with a plurality of first slits of a specific width formed at equal intervals, and at one end thereof a second slit of a different width than the first slits, disposed parallel to the carriage shaft. The carriage also has a detection unit that scans the scale in conjunction with bidirectional movement of the carriage, and detects the first slits and the second slit. During initialization, the conveyance unit moves the carriage a specific distance away from the one end, then reverses and moves the carriage until the detection unit detects the second slit. The home position of the carriage is set based on the position where this second slit was detected.

Effect of the Invention

The invention forms a second slit of a different width than the first slits at one end of the first slits, and enables knowing the position of the first carriage and the location of the home position based on the first slits and the position of the second slit at the one end detected by the first detector carried on the first carriage. In addition, because the position of the first carriage and the home position can be detected using a simple configuration, these positions can be accurately detected without providing multiple dedicated sensors.

Furthermore, by providing a first carriage and a second carriage on opposite sides of the conveyance path, the front and back sides of the recording medium can be recorded.

In addition, because the first scale and the second scale are disposed so that the second slit and the fourth slit are on the same end on opposite sides of the conveyance path, recording both sides of the recording medium from the same end of the paper can start easily referenced to the positions of the second slit and the fourth slit. More specifically, when printing on both the front and back sides of the recording medium, starting printing both sides referenced to the same end of the recording paper can be done easily.

In addition, because the carriage is moved a specific distance away from the one end of the scale and is then reversed to detect the second slit, the home position can be set and detected accurately and reliably wherever the carriage is positioned.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Figure 1:
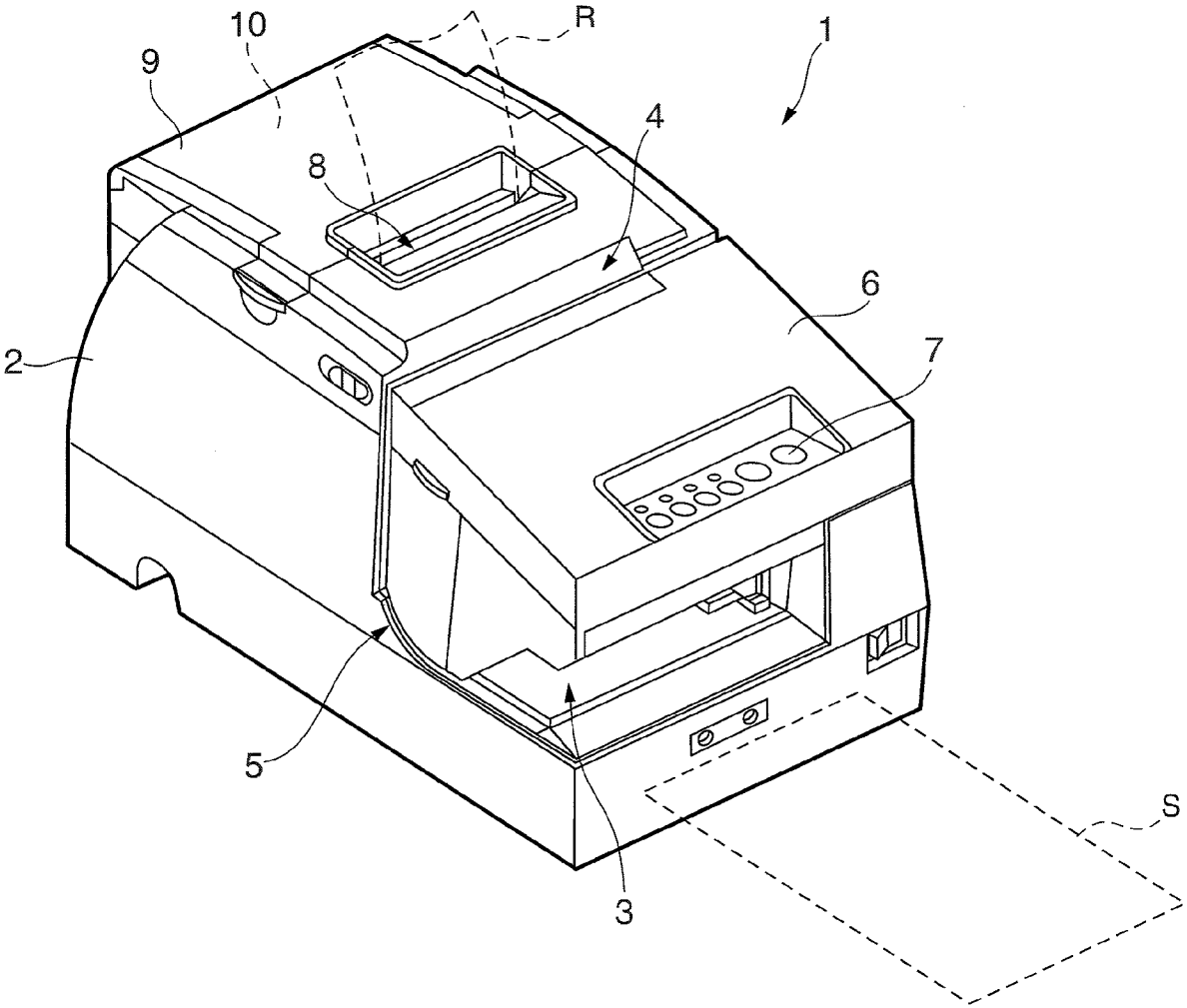
FIG. 1 is an external oblique view of a hybrid processing device according to a preferred embodiment of the invention.

FIG. 1 is an external oblique view of a hybrid processing device as an example of a media processing device according to a preferred embodiment of the invention. This hybrid processing device (media processing device) 1 reads an MICR (magnetic ink character recognition) line of magnetic ink characters recorded on a check (recording medium) S. Based on the result of the content, the hybrid processing device 1 performs a printing (recording) process on the check S, and performs a printing (recording) process on the roll paper.

As shown in FIG. 1, the hybrid processing device 1 has a basically rectangular box-like case 2. A media entrance 3 for inserting a check S is disposed with a specific width transversely to the device at the front left side of the case 2. A media exit 4 from which the processed check S is discharged is disposed with a specific width transversely to the device in the top of the case 2 in the middle of the longitudinal direction, that is, between the front and back of the device. A media conveyance path 5 that extends from the media entrance 3 in a curve to the back and top is formed between the media entrance 3 and media exit 4. The media entrance 3, media exit 4, and media conveyance path 5 are formed opening to the left side of the case 2, enabling conveying a check S that is wider than the media entrance 3, media exit 4, and media conveyance path 5.

A front cover 6 covers the top of the case 2 in front of the media exit 4, and an operating panel 7 used to operate the hybrid processing device 1 is disposed at the front end of the front cover 6. A roll paper exit 8 from which the roll paper R is discharged after printing is disposed with a specific width transversely to the device in the top of the case 2 behind the media exit 4. An access cover 9 is also disposed to the top of the case 2 behind the roll paper exit 8, and this access cover 9 is attached pivotably at the rear end thereof to the case 2. When the access cover 9 opens, the roll paper compartment 10 that stores the roll paper R is exposed and the roll paper R can be replaced. The roll paper R is a web of thermal paper wound onto a core into a roll.

Figure 2:
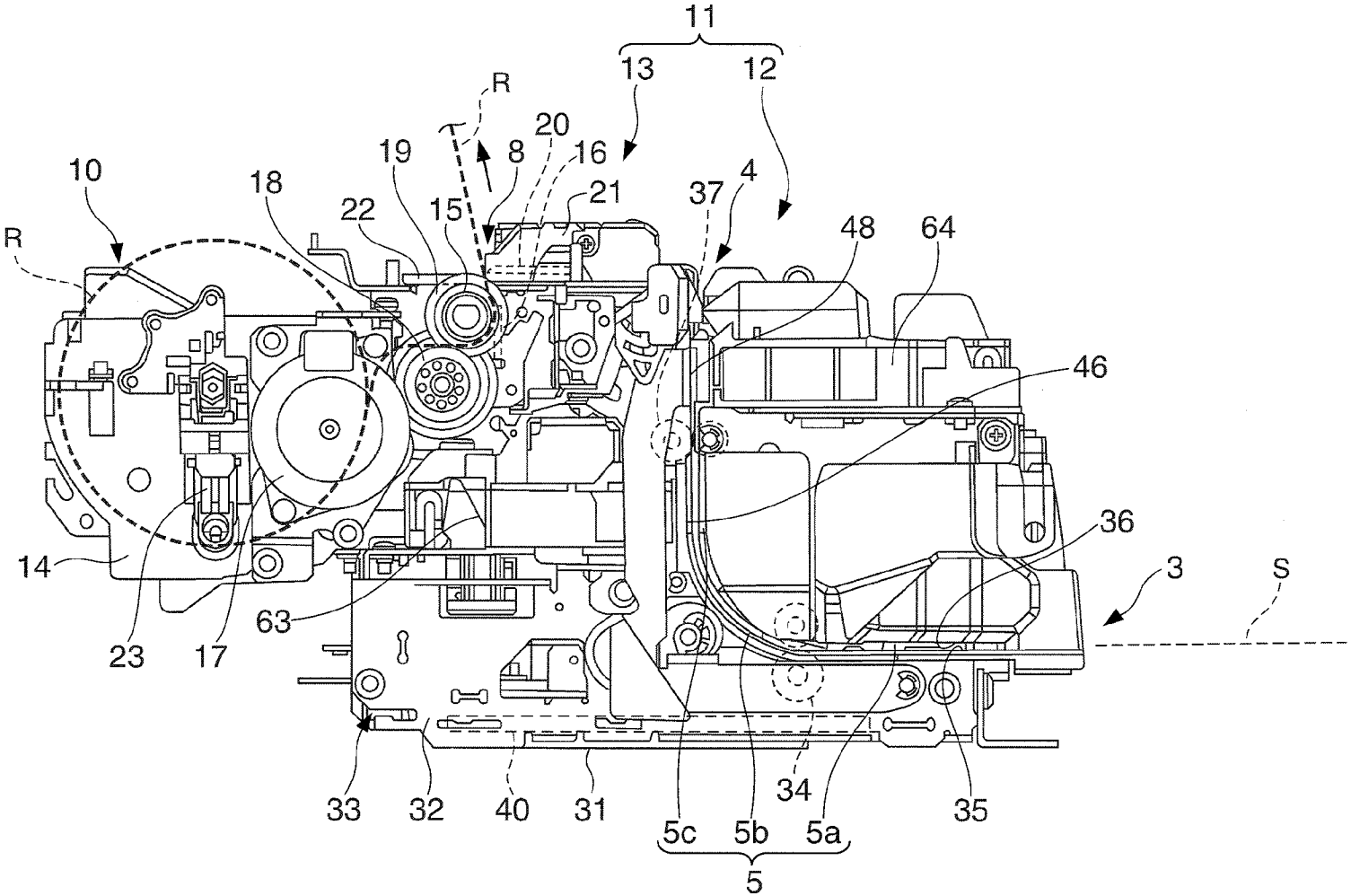
FIG. 2 is a schematic side view of the main unit of the hybrid processing device.

FIG. 2 is a side view showing the main unit of the hybrid processing device 1. FIG. 2 shows the hybrid processing device 1 with the case 2, front cover 6, access cover 9, and other exterior parts removed. As shown in FIG. 2, the hybrid processing device 1 has a main unit 11, and the main unit 11 includes a slip print unit 12 for printing on checks S and other slips, and a roll paper print unit 13 for printing on roll paper R, rendered in unison.

The roll paper print unit 13 includes a left side frame 14 and a paired right side frame not shown, and a roll paper holder (not shown in the figure) disposed between the side frames and forming the bottom, front, and back sides of the roll paper compartment 10. This roll paper holder holds the roll paper R so that the roll paper can rotate freely, and assures that the roll paper R can roll freely inside the roll paper compartment 10.

A platen roller 15 is disposed freely rotatably between the left and right side frames near the roll paper exit 8.

A thermal printhead 16 is disposed in front of the platen roller 15 at a position opposite the platen roller 15, and the thermal printhead 16 has a plurality of heating resistors in the face thereof opposing the platen roller 15. The leading end of the roll paper R stored in the roll paper compartment 10 is held between the platen roller 15 and thermal printhead 16, and is conveyed toward the roll paper exit 8 by rotation of the platen roller 15. When the roll paper R passes between the platen roller 15 and thermal printhead 16, content such as text and images is recorded on the roll paper R by heat emitted from the thermal printhead 16. A roll paper conveyance motor 17 is disposed to the left side frame 14. Rotation of the roll paper conveyance motor 17 is transferred through an intermediate gear 18 to a drive gear 19 disposed coaxially to the platen roller 15, and the platen roller 15 turns.

An automatic paper cutter unit 21 with an internal movable knife 20 and a cutter drive motor 24 (see FIG. 4) for operating the movable knife 20 is disposed above the platen roller 15. A fixed knife 22 is disposed behind the automatic paper cutter unit 21 with the roll paper exit 8 therebetween. The leading end part of the roll paper R passes between the movable knife 20 and fixed knife 22 to the roll paper exit 8, and when the roll paper R is cut, the cutter drive motor 24 causes the movable knife 20 to move to the back toward the fixed knife 22 and together with the fixed knife 22 cut the roll paper R.

A remaining roll paper sensor 23 that detects how much roll paper R remains inside the roll paper compartment 10 is also disposed to the left side frame 14.

As shown in FIG. 2, the slip print unit 12 has a main frame 33 including a base frame 31 and a left side frame 32 and a right side frame (not shown in the figure) that rise from the base frame 31. A pair of top and bottom paper guide members forming a bottom guide surface 35 and a top guide surface 36 are disposed to the main frame 33, and the gap between the bottom guide surface 35 and top guide surface 36 is formed as the media conveyance path 5. This media conveyance path 5 includes a horizontal conveyance path portion 5*a* that extends from the media entrance 3 horizontally toward the back of the device, a curved conveyance path portion 5*b* that curves upward from the back end of the horizontal conveyance path portion 5*a*, and a vertical conveyance path portion 5*c* that extends up from the top end of the curved conveyance path portion 5*b* and connects to the media exit 4.

A pair of first conveyance rollers 34 are disposed in mutual opposition to the bottom guide surface 35 and top guide surface 36 at the junction between the horizontal conveyance path portion 5*a* and curved conveyance path portion 5*b*. A pair of second conveyance rollers 37 is disposed in opposition at the bottom guide surface 35 and top guide surface 36 of the vertical conveyance path portion 5*c*. The first conveyance rollers 34 and the second conveyance rollers 37 rotate when driven by the slip conveyance motor 38 (FIG. 4) and convey the check S.

The first conveyance rollers 34 and second conveyance rollers 37 are configured so that one roller of each roller pair can move to and away from the other roller, and open and close the media conveyance path 5 when the roller pairs are driven together or apart by a roller opening motor 39 (FIG. 4) connected to the one roller of each pair.

A control circuit board 40 that controls overall operation of the hybrid processing device 1 based on a control program is also disposed to the base frame 31.

Figure 3:
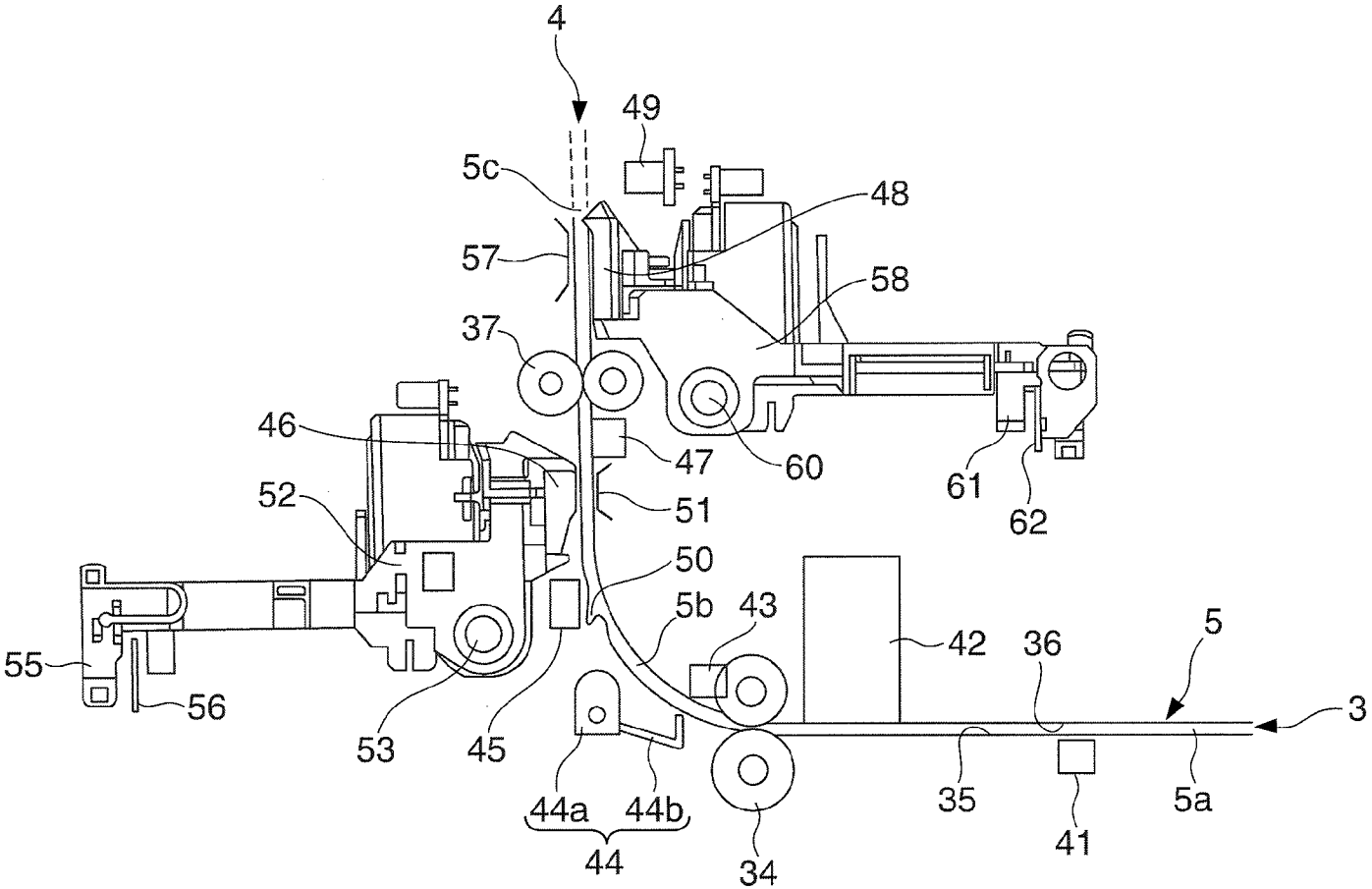
FIG. 3 shows various parts disposed to the media conveyance path.

FIG. 3 shows selected components disposed along the media conveyance path 5.

Disposed to the media conveyance path 5 in sequence from the media entrance 3 side are a BOF (bottom of form) sensor 41, MICR head 42, first conveyance rollers 34, TOF (top of form) sensor 43 (first recording medium detector), alignment unit 44, validation sensor 45, first printhead (recording head) 46, MOP (middle of paper pass) sensor 47, second conveyance rollers 37, second printhead (other recording head) 48, and EJD (slip ejection detector) sensor 49.

The BOF sensor 41, TOF sensor 43, validation sensor 45, MOP sensor 47, and EJD sensor 49 are, for example, transmissive or reflective photosensors, and contactlessly detect the presence of a check S at their respective positions on the media conveyance path 5.

The BOF sensor 41 detects the trailing end of a check S inserted from the media entrance 3, and is disposed to the bottom guide surface 35 near the media entrance 3.

The TOF sensor 43 detects the leading end of a check S inserted from the media entrance 3, and is disposed to the top guide surface 36 on the side closer to the paper exit than the first conveyance rollers 34.

The EJD sensor 49 detects discharge of a check S processed by the slip print unit 12 from the media exit 4, and is disposed near the media exit 4.

The MOP sensor 47 detects the presence of a check S conveyed through the media conveyance path 5, and is disposed to the top guide surface 36 on the side closer to the paper entrance than the second conveyance rollers 37.

The slip print unit 12 in this embodiment of the invention can perform a validation printing process that prints on a check S inserted from the media exit 4 by the first printhead 46 and second printhead 48, and then discharges the check S after printing from the media exit 4. As a result, a recess 50 that aligns the check S as a result of the leading end of the check S inserted from the media exit 4 entering the recess 50 is formed at the upper end of the curved conveyance path portion 5*b* of the media conveyance path 5. The validation sensor 45 detects entry of the leading end of the check S to the recess 50, and is disposed to a position opposite the recess 50.

The MICR head 42 reads magnetic ink characters recorded on the surface of a check S, and is disposed to the top guide surface 36 in the horizontal conveyance path portion 5*a* of the media conveyance path 5. The presence of a check S is determined based on the data read by the MICR head 42.

The alignment unit 44 pauses the check S inserted from the media entrance 3, and is disposed on the media exit 4 side of the TOF sensor 43. The alignment unit includes a stopper drive unit 44*a* such as a solenoid, for example, and a stop 44*b* that moves in and out of the media conveyance path 5 according to how the stopper drive unit 44*a* is operated, and a check S is aligned by the leading end of the check S stopping at the stop 44*b*.

The first printhead 46 is for printing required endorsement information required by the business, such as a customer identification number, date, and check amount, on the back side of the check S conveyed through the media conveyance path 5, and is a serial impact dot matrix (SIDM) printhead that prints by striking an ink ribbon with the recording wires to transfer ink from the ink ribbon onto the recording medium. This first printhead 46 is located at the lower end of the vertical conveyance path portion 5*c* of the media conveyance path 5. A first platen 51 is disposed widthwise to the main frame 33 (FIG. 2) at a position opposite the first printhead 46 with the vertical conveyance path portion 5*c* therebetween. The first printhead 46 is mounted on a first carriage 52 disposed on the side of the vertical conveyance path portion 5*c* toward the back of the device. This first carriage 52 can slide freely along a first carriage shaft 53 disposed horizontally between the side frames of the main frame 33 (FIG. 2), and moves bidirectionally along the first carriage shaft 53 when driven by the first carriage motor (conveyance unit, FIG. 4) 54. The first carriage 52 is connected to a first carriage motor 54 by an intervening timing belt (not shown in the figure). This first carriage motor 54 is a stepper motor, and can move the first carriage 52 the distance equivalent to a desired number of steps as controlled by the control circuit board 40.

A first carriage sensor (detection unit) 55 that detects the position of the first carriage 52 is disposed to the bottom of the first carriage 52. This first carriage sensor 55 is a transmissive photosensor, and scans a first scale 56 disposed parallel to the first carriage shaft 53 in conjunction with the bidirectional movement of the first carriage 52.

Multiple slits of a specified width are formed in this first scale 56, and displacement of the first carriage 52 is detected and the position of the first carriage 52 (first printhead 46) is detected by capturing the optical signals passing these slits as the first carriage sensor 55 scans the first scale 56. In this embodiment of the invention power is supplied to the first carriage sensor 55 only while driving the first carriage motor 54, and because power supply to the first carriage sensor 55 stops when the first carriage motor 54 stops, power consumption is reduced while waiting and reduced power consumption can be achieved.

The second printhead 48 prints the payee, date, check amount, and other essential information on the front of the check S conveyed through the media conveyance path 5, and is rendered by a SIDM printhead identically to the first printhead 46. This second printhead 48 is located above the first printhead 46, and is disposed on the side of the vertical conveyance path portion 5*c* to the front of the device. A second platen 57 is disposed widthwise to the main frame 33 (FIG. 2) at a position opposite the second printhead 48 with the vertical conveyance path portion 5*c* therebetween.

Like the first printhead 46, the second printhead 48 is carried on a second carriage (other carriage) 58, and this second carriage 58 moves bidirectionally along a second carriage shaft (other carriage shaft) 60 as driven by a second carriage motor (other conveyance unit, FIG. 4) 59.

A second carriage sensor (other detection unit) 61 is disposed to the bottom of the second carriage 58, and this second carriage sensor 61 scans a second scale (other scale) 62 disposed parallel to the second carriage shaft 60 in conjunction with bidirectional movement of the second carriage 58.

Note that the second carriage motor 59 is also rendered by a stepper motor similarly to the first carriage motor 54.

A first ink ribbon cassette 63 (FIG. 2) and a second ink ribbon cassette 64 (FIG. 2) that store the ink ribbons that are conveyed respectively between the first printhead 46 and first platen 51 and the second printhead 48 and second platen 57 are removably installed to the main frame 33.

Figure 4:
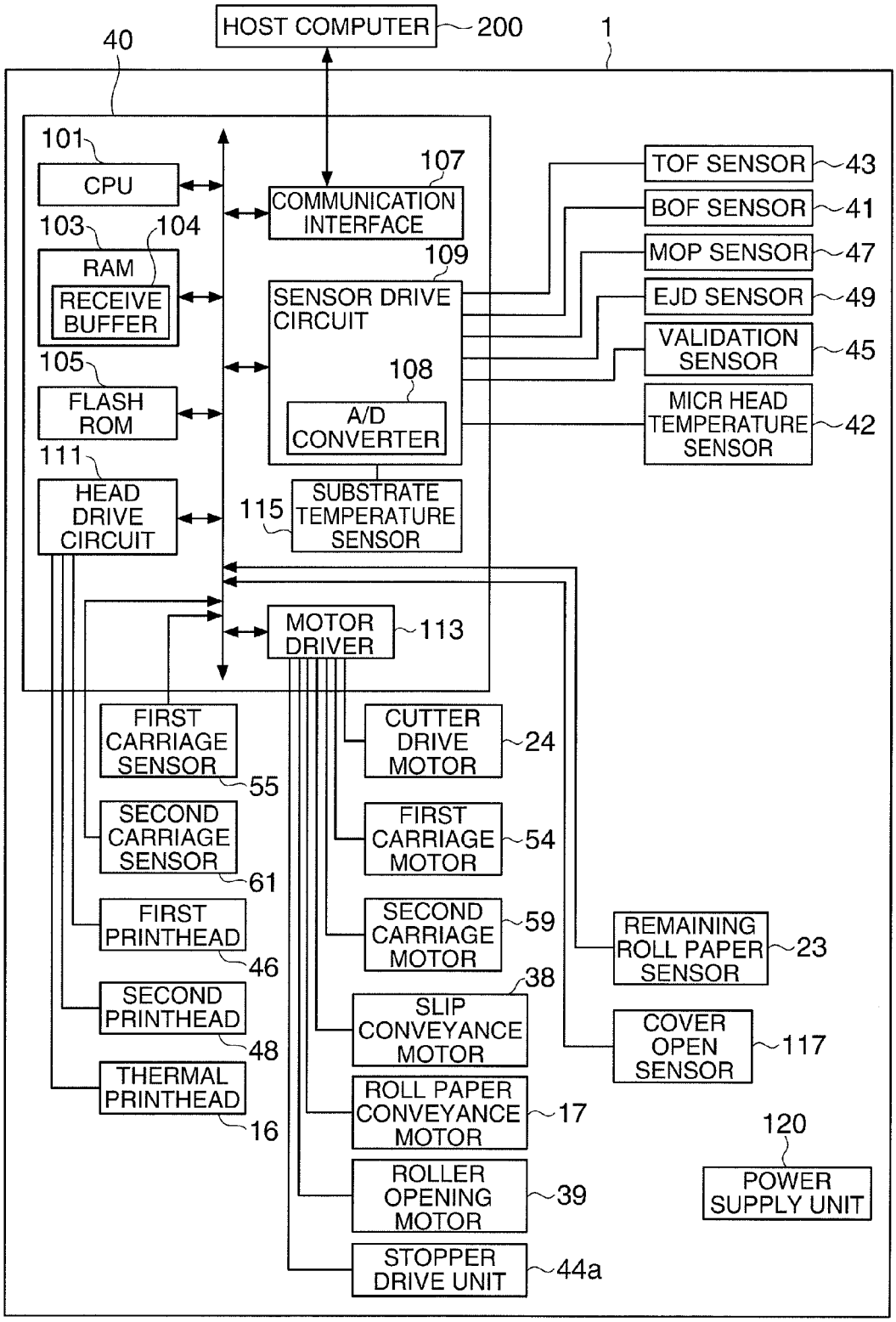
FIG. 4 is a block diagram of the functional configuration of the hybrid processing device.

FIG. 4 is a block diagram showing the functional configuration of the hybrid processing device 1.

As shown in FIG. 4, the control system of the hybrid processing device 1 includes various drive units such as motors and various sensors connected to a control unit mounted on the control circuit board 40.

The control circuit board 40 includes a CPU 101 that executes a control program and controls other parts; RAM 103 that temporarily stores processed data and the programs executed by the CPU 101; flash ROM 105 that stores settings and the basic control program executed by the CPU 101; a communication interface 107 that communicates commands and data with a host computer 200 as an external device connected to the hybrid processing device 1; a sensor drive circuit 109 that has an internal A/D (analog/digital) converter 108 and converts output from the sensors of the hybrid processing device 1 to digital data and outputs to the CPU 101; a head drive circuit 111 that drives the printheads of the hybrid processing device 1; and a motor driver 113 that drives the motors of the hybrid processing device 1. These parts are communicably connected to each other. Note, further, that how the various functional parts of the control circuit board 40 are specifically rendered can be determined as desired, including rendering individual units as discrete semiconductor devices, and rendering the functions of plural functional parts using a system-on-a-chip (SOC) design.

A substrate temperature sensor 115 that detects the temperature of the motor driver 113 is mounted on the control circuit board 40. The substrate temperature sensor 115 is a thermistor disposed on the back side of the control circuit board 40 where the motor driver 113 is mounted, or near the motor driver 113.

A remaining roll paper sensor 23 that detects if the amount of roll paper R stored in the roll paper compartment 10 (FIG. 1) exceeds a particular amount, a cover open sensor 117 that detects if the access cover 9 is open, and the first carriage sensor 55 and second carriage sensor 61 described above, are connected to the CPU 101.

The remaining roll paper sensor 23 is a switch that turns on when the outside diameter of the roll paper R is greater than or equal to a set size, the cover open sensor 117 is a switch that turns on when the access cover 9 opens, and both sensors change the output value to high or low according to the respective on/off state. The first carriage sensor 55 and second carriage sensor 61 are rendered as photo interrupters, for example, and switch the output HIGH/LOW according to whether or not the amount of light detected by the light receiving unit exceeds an internally stored threshold value.

The CPU 101 controls parts mounted on the control circuit board 40 by reading and executing the basic control program stored in flash ROM 105. Based on the sensor values input through the sensor drive circuit 109, and the output values of the remaining roll paper sensor 23, cover open sensor 117, first carriage sensor 55, and second carriage sensor 61, the CPU 101 performs operations including monitoring the operating status of the hybrid processing device 1, driving the heads by the head drive circuit 111, operating the motors by the motor driver 113, printing on the front and back sides of the check S, reading the MICR line, and printing on the roll paper R.

RAM 103 is used as working memory for temporarily storing programs and data used for CPU 101 operation. A receive buffer 104 that temporarily stores commands and data received from the host computer 200 through the communication interface 107 is provided in RAM 103. The CPU 101 reads and executes the commands stored in the receive buffer 104 in the order received.

The sensor drive circuit 109 is connected to the BOF sensor 41, TOF sensor 43, validation sensor 45, MOP sensor 47, EJD sensor 49, and substrate temperature sensor 115, converts the sensor output values to digital data, and outputs the digital data to the CPU 101. The sensor drive circuit 109 is also connected to the MICR head 42, and outputs the output values of the MICR head 42 as digital data to the CPU 101 while reading the magnetic ink characters printed on the check S by the MICR head 42.

The head drive circuit 111 records on a check S by energizing the solenoid coils of the first printhead 46 and second printhead 48 to make the recording wires strike the ink ribbon as controlled by the CPU 101. The head drive circuit 111 also energizes the heating elements (not shown in the figure) of the thermal printhead 16 as controlled by the CPU 101 to apply heat to and record on the recording surface of the roll paper R.

The motor driver 113 outputs drive power and drive pulses as controlled by the CPU 101 to the roll paper conveyance motor 17, cutter drive motor 24, slip conveyance motor 38, roller opening motor 39, stopper drive unit 44*a*, first carriage motor 54, and second carriage motor 59, which are stepper motors. The drive power supplied to the motors by the motor driver 113 is 24-VDC power supplied from the power supply unit 120 to the different parts. The power supply unit 120 supplies DC power to the drive units of the hybrid processing device 1 shown in FIG. 4, that is, the printheads (first printhead 46, second printhead 48, and thermal printhead 16), motors (cutter drive motor 24, first carriage motor 54, second carriage motor 59, slip conveyance motor 38, roll paper conveyance motor 17, and roller opening motor 39), the stopper drive unit 44*a*, and the control circuit board 40. Power is also supplied from the power supply unit 120 to the sensors of the hybrid processing device 1 through the control circuit board 40, or through the sensor drive circuit 109 mounted on the control circuit board 40.

This hybrid processing device 1 enters a standby mode after the power turns on. In this standby mode the hybrid processing device 1 moves the first conveyance rollers 34 and second conveyance rollers 37 to the open position by the roller opening motor 39, and a check S can be inserted to the media entrance 3. The stop 44*b* is also moved into the media conveyance path 5 by the stopper drive unit 44*a*.

When insertion of a check S from the media entrance 3 is detected in this standby state, the CPU 101 detects the check S based on the output value of the BOF sensor 41 input from the sensor drive circuit 109. The CPU 101 then controls the motor driver 113 to drive the roller opening motor 39 and move the first conveyance rollers 34 and second conveyance rollers 37 to the closed position so that the check S is held by the first conveyance rollers 34.

With the stop 44*b* intervening in the media conveyance path 5, the CPU 101 then operates the slip conveyance motor 38 and rotationally drives the first conveyance rollers 34 to align the check S by moving it back and forth plural times. This operation drives the check S against the stop 44*b* and aligns its orientation.

When reading magnetic ink characters is instructed by a command received from the host computer 200, the CPU 101 drives the stopper drive unit 44*a* and retracts the stop 44*b* from the media conveyance path 5.

The CPU 101 then reads the magnetic ink characters on the check S based on output values from the MICR head 42 while conveying the check S by the first conveyance rollers 34.

When printing on the back of the check S is instructed by a command received from the host computer 200, the CPU 101 conveys the check S to the printing position and then prints on the back of the check S by the first printhead 46.

When printing on the front of the check S is instructed by a command received from the host computer 200, the CPU 101 conveys the check S to the front printing position. More specifically, the CPU 101 conveys the check S to the printing position by driving the slip conveyance motor 38 forward and conveying the check S to the downstream side of the media conveyance path 5, or reversing the slip conveyance motor 38 and conveying the check S to the upstream side of the media conveyance path 5 according to the printing position on the check S. After the check S reaches the front printing position, the CPU 101 controls the head drive circuit 111 and prints on the front of the check S by the second printhead 48.

After printing the check front ends, the CPU 101 drives the slip conveyance motor 38 and discharges the check S from the media exit 4 by the second conveyance rollers 37.

The check S reaches the position protruding from the media exit 4 at this time, but the trailing end of the check S is still inside the media exit 4 and the presence of the check S is detected by the EJD sensor 49. The CPU 101 waits until the operator removes the check S, and when the check S is removed and the CPU 101 detects the change in the detection state of the EJD sensor 49, the CPU 101 drives the roller opening motor 39 and stopper drive unit 44*a*, and returns to the standby mode described above. As a result, the magnetic ink characters are read and the front and back of the check S are printed when a check S is inserted.

When a check S is inserted from the media exit 4 in the standby mode and the leading end thereof reaches the recess 50, the CPU 101 detects insertion of a check S based on change in the output from the validation sensor 45. The CPU 101 then performs a validation printing process on the check S using the first printhead 46 or second printhead 48 according to a print command received from the host computer 200. When printing is completed, the CPU 101 waits for the operator to remove the check S. When removal of the check S is detected based on change in output from the validation sensor 45 and EJD sensor 49, the CPU 101 returns to the standby mode.

When a command for printing on roll paper R is received from the host computer 200, the CPU 101 reads and executes the command from the receive buffer 104. The CPU 101 prints by energizing the thermal printhead 16 and applying heat to the printing surface of the roll paper R while driving the roll paper conveyance motor 17 and conveying the roll paper R. When printing is completed, the CPU 101 conveys the roll paper R until the end of the printing position on the roll paper R is at the automatic paper cutter unit 21, and then drives the cutter drive motor 24 to cut the roll paper R.

As described above, a hybrid processing device 1 according to this embodiment of the invention detects the displacement of the first carriage 52 and detects the position of the first carriage 52 by acquiring optical signals through slits formed in the first scale 56 when the first carriage sensor 55 on the first carriage 52 scans the first scale 56. The location of the second carriage 58 is detected the same way.

Because these carriage positions are detected based on displacement from a reference position, detecting the reference position, that is, detecting the home position, is extremely important to position detection. Because the configuration of the related art uses dedicated sensors for home position detection and detecting the position of the carriage, the number of sensors used in the hybrid processing device increases and cost increases accordingly.

This embodiment of the invention is characterized by accurately detecting the home position and the carriage position based on signals from a carriage sensor that scans a scale.

Figure 5:
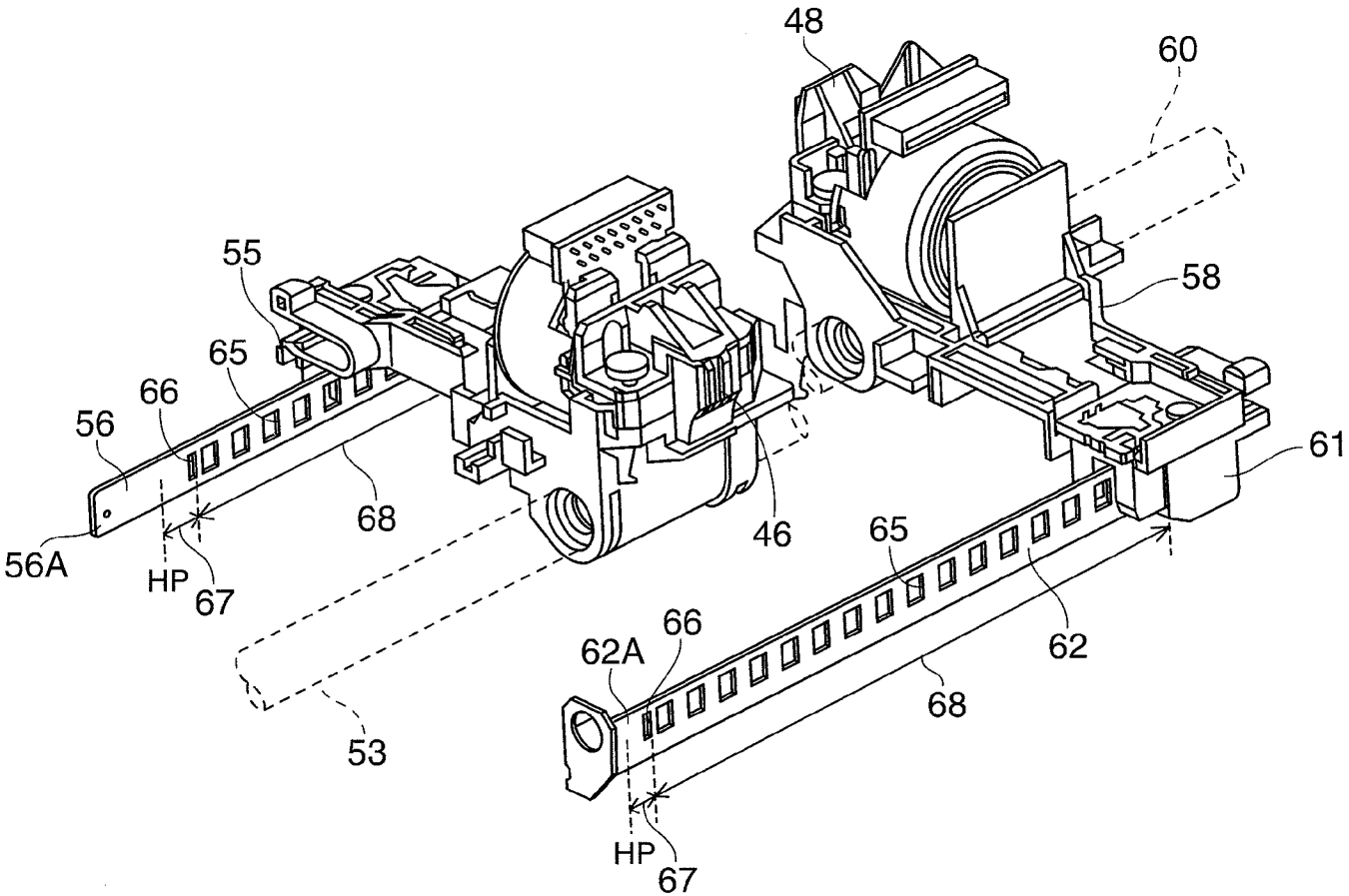
FIG. 5 is an oblique view of the first carriage and second carriage and surroundings.

FIG. 5 is an oblique view of the area around the first carriage 52 and second carriage 58.

As described above, the first carriage 52 and second carriage 58 have a first carriage sensor 55 and second carriage sensor 61, respectively, and the first carriage sensor 55 and second carriage sensor 61 respectively scan a first scale 56 and a second scale 62.

The first scale 56 has wide slits (first slits, third slits) 65 disposed at a specific interval across the entire width of the first scale 56, and a narrow slit (second slit, fourth slit) 66 that is narrower than the wide slits 65 and is formed at one end 56A of the first scale 56.

The wide slits 65 are used mainly for detecting the position of the first carriage 52 during normal print operations, and the narrow slit 66 is used for setting the home position HP of the first carriage 52 and for detecting the home position HP.

The distance between adjacent wide slits 65 is the same as the width of a wide slit 65 (such as 10 steps), and the distance between the wide slit 65 and the narrow slit 66 is the same as the width of the narrow slit 66 (such as 4 steps).

The home position HP is set between the narrow slit 66 and the one end 56A of the first scale 56, and the range 67 from the home position HP and including the narrow slit 66 is set as a deceleration range for the first carriage 52 to accelerate to a specified print speed and to decelerate from this print speed and stop at the home position HP.

The range 68 in which the wide slits 65 are formed adjacent to the range 67 is set as the printing range for printing by the first printhead 46. The first carriage 52 moves at a specific print speed in the printing range.

Note that the second scale 62 is constructed identically to the first scale 56, the same reference numerals are therefore used, and further description thereof is omitted.

As shown in FIG. 5, the first scale 56 and second scale 62 are disposed opposite each other with the media conveyance path 5 (FIG. 3) therebetween and the narrow slits 66 formed at the same end of each scale. As a result, because the home position HP of each carriage 52, 58, which is set using the narrow slit 66, can be set at the same side of the hybrid processing device 1, the start-printing positions can be easily adjusted to each other, such as aligning the start-printing positions of the front and back sides of a check S to the left end of the check S, and recording quality can be improved using a simple construction. In addition, by setting the home position HP of carriages 52, 58 on the same side of the hybrid processing device 1, the size of the printing range relative to the width of the hybrid processing device 1 can be increased compared with a configuration having the home positions HP on different sides.

The operation of setting the home position HP in this embodiment of the invention is described next.

Figure 6:
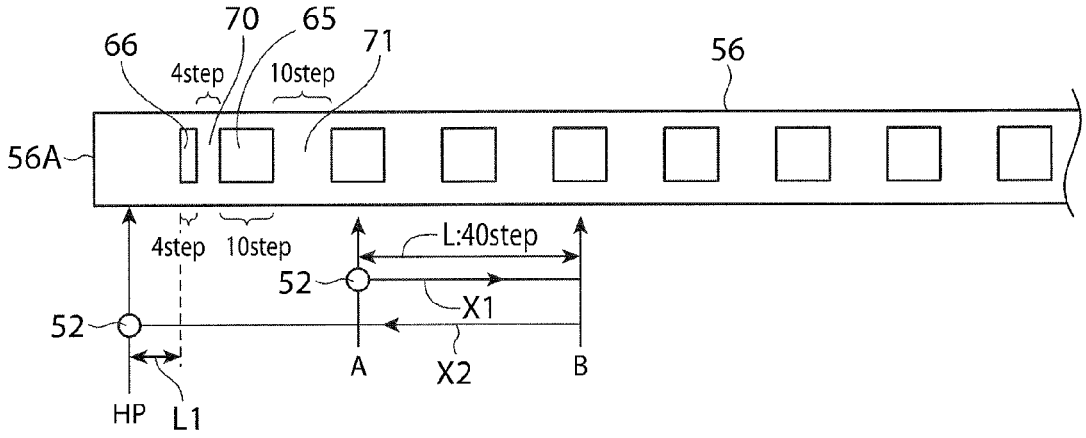
FIG. 6 shows the track of the carriage when setting the home position.
Figure 7:
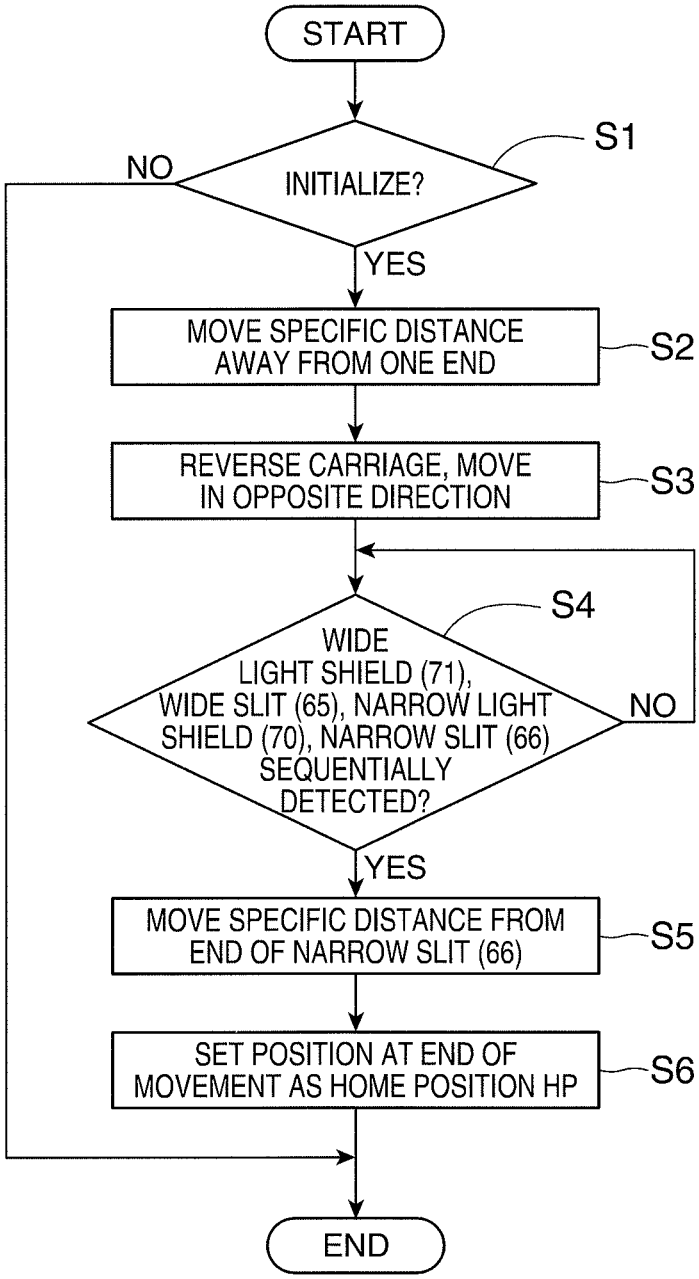
FIG. 7 is a flow chart of the home position setting process.

FIG. 6 schematically describes the path of carriage travel when setting the home position HP, and FIG. 7 is a flow chart of this operation. Because the same operation is controlled for the first carriage 52 and the second carriage 58 in this embodiment of the invention, the first carriage 52 is used for the operation described below, and description of the second carriage 58 is omitted.

The CPU 101 first determines whether the hybrid processing device 1 is initializing the first carriage 52 (step S1). Initialization detected in step S1 includes when the hybrid processing device 1 power turns on and when an open front cover 6 is closed. This is because the first carriage 52 is expected to be moved from the home position HP when the front cover 6 opens.

If step S1 determines that initialization is not required (step S1 returns No), this process ends. If initialization is required (step S1 returns Yes), the CPU 101 moves the first carriage 52 from initial position A a specific distance L away from the one end 56A of the first scale 56 (the direction of arrow X1 in the figure) (step S2) as shown in FIG. 6. More specifically, the CPU 101 drives the first carriage motor 54 a specific distance L (40 steps) in direction X1 by the motor driver 113.

This specific distance L is set to a distance greater than the combined width of a wide slit 65, the narrow slit 66, and the width of a narrow light shield 70 disposed between the narrow slit 66 and adjacent wide slit 65.

The CPU 101 then stops the first carriage motor 54 at a position B specific distance L from the initial position A, reverses the motor 54, and moves the first carriage 52 toward the one end 56A of the first scale 56 (direction X2 in FIG. 6) (step S3). Based on output from the first carriage sensor 55 and the first carriage motor 54 drive signal, the CPU 101 then determines if a wide light shield 71 formed between adjacent wide slits 65, wide slit 65, narrow light shield 70, and narrow slit 66 were detected in sequence (step S4).

If step S4 determines that the wide light shield 71, wide slit 65, narrow light shield 70, and narrow slit 66 were not detected in sequence (step S4 returns No), processing continues until they are detected. If the wide light shield 71, wide slit 65, narrow light shield 70, and narrow slit 66 are detected in sequence (step S4 returns Yes), the CPU 101 drives the first carriage motor 54 and moves the first carriage 52 specific distance L1 (plural steps) from the end of the narrow slit 66 (step S5), sets that position as the home position HP (step S6), and ends this process.

The position of the first carriage 52 can thus be accurately and reliably detected based on whether the wide light shield 71, wide slit 65, narrow light shield 70, and narrow slit 66 were detected in sequence, and detection errors can be reduced significantly compared with simply detecting the narrow slit 66.

As described above, this embodiment of the invention has carriage motors 54, 59 that move carriages 52, 58 bidirectionally along carriage shafts 53, 60, and printheads 46, 48 carried on the carriages 52, 58; and has scales 56, 62 each having a plurality of wide slits 65 of a specific width formed at equal intervals and a narrow slit 66 formed on one end 56A, 62A disposed parallel to the carriage shafts 53, 60. The carriages 52, 58 each have a carriage sensor 55, 61 that scans the scale 56, 62 and detects the wide slits 65 and narrow slit 66 while the carriages 52, 58 move back and forth. When the carriages 52, 58 are initialized, the carriage motors 54, 59 are controlled to move the carriages 52, 58 a specific distance L away from the one end 56A, 62A, then reverse and move the carriages 52, 58 at least until the carriage sensors 55, 61 detect the narrow slit 66, and the home position HP is set based on the detected position of the narrow slit 66. As a result, the home position HP can be set by a simple construction without providing dedicated sensors.

In addition, because the home position HP is detected based on the detected position of the narrow slit 66, the home position HP can be accurately detected when printing without providing dedicated sensors by using carriage sensor 55, 61.

Furthermore, because the first carriage 52 is reversed and the narrow slit 66 is detected after moving the carriages 52, 58 specific distance L in direction X1 away from the one end 56A, 62A of the scales 56, 62, the home position HP can be set and detected accurately and reliably regardless of where the carriages 52, 58 are positioned.

Because specific distance L in this embodiment of the invention is set to a distance at least greater than the combined length of the width of a wide slit 65, the width of the narrow slit 66, and the width of the narrow light shield 70 disposed between the narrow slit 66 and wide slit 65, the carriage sensors 55, 61 can detect a wide slit 65 of a different width than the narrow slit 66 before detecting the narrow slit 66 by moving the carriages 52, 58 away from the narrow slit 66 a distance greater than the combined length of the width of a wide slit 65, the width of the narrow slit 66, and the width of the narrow light shield 70 disposed between the narrow slit 66 and wide slit 65, and then moving the carriages 52, 58 until the narrow slit 66 is detected, even if the carriages 52, 58 are stopped near the home position HP before initialization, for example.

As a result, by detecting a wide slit 65 and then the narrow slit 66 in sequence, home position HP detection errors can be prevented, and the home position HP can be accurately set and detected.

Detecting errors in first carriage movement, such as detecting loss of synchronization of the first carriage motor 54, is described next. Loss of synchronization is detected when printing with the first printhead 46 on the first carriage 52. In this case, the CPU 101 compares the number of steps the first carriage motor 54 was driven through the motor driver 113, and the distance the first carriage 52 actually moved, and determines from the result if the first carriage motor 54 is out of synchronization. The actual distance the first carriage 52 moved can be determined from the number of slits detected by the first carriage sensor 55 travelling passed the slits of the first scale 56, and the distance between the slits. Loss of synchronization can thus be detected in this embodiment of the invention using the first scale 56 and first carriage sensor 55 used for detecting the position of the first carriage 52, and device construction can be simplified.

In this configuration loss of synchronization detection is prohibited in the deceleration range used for first carriage 52 acceleration and deceleration. Because uneven rotation can easily result and the speed can vary due to vibration of the first carriage motor 54 in the deceleration range, for example, detection errors result easily if loss of synchronization of the first carriage motor 54 is detected from change in speed, for example, and accurate detection is difficult in the deceleration range.

Therefore, by prohibiting detecting loss of synchronization in the deceleration range, loss of synchronization detection errors accompanying the first carriage 52 accelerating or decelerating can be prevented, and the position of the first carriage 52 can be accurately controlled.

The second carriage 58 operates identically to the first carriage 52, and further description of the second carriage 58 is thus omitted.

A preferred embodiment of the invention is described above, but the invention is not so limited. For example, the hybrid processing device in the embodiment described above has a roll paper print unit 13 that prints on roll paper R, but the invention can also be applied to a configuration having a slip print unit 12.

In addition, the slip print unit 12 in this embodiment of the invention is configured with a dot impact printhead, but the invention can also be used with other types of printheads that are driven mounted on a carriage, including inkjet printheads.

In addition, a program that causes the CPU 101 to perform the operation in the flow chart described above can be stored to and read and executed from a recording medium in the hybrid processing device 1 or a storage medium that is externally connected.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A media processing device comprising:

a conveyance path configured to convey a recording medium;

on one side of the conveyance path a first recording head configured to record on one side of the recording medium, a first carriage configured to carry the first recording head, a first conveyance unit configured to move the first carriage on a first carriage shaft, a first scale having a plurality of first slits of a specific width formed with a specific interval therebetween, and at one end thereof a second slit of a different width than the first slit, and a first detection unit that is carried on the first carriage and detects the first slits and the second slit of the first scale; and on the other side of the conveyance path a second recording head configured to record on the other side of the recording medium, a second carriage configured to carry the second recording head, a second conveyance unit configured to move the second carriage on a second carriage shaft, a second scale having a plurality of third slits of a specific width formed with a specific interval therebetween, and at one end thereof a fourth slit of a different width than the third slit, and a second detection unit that is carried on the second carriage and detects the third slits and the fourth slit of the second scale; and a control unit configured to drive the first conveyance unit and moves the first carriage a first specific distance away from the one end of the first scale, to reverse and move the first carriage at least until the first detection unit detects the second slit, to set the first carriage home position based on the position where the second slit was detected, to drive the second conveyance unit and moves the second carriage a second specific distance away from the one end of the second scale, to reverse and move the second carriage at least until the second detection unit detects the fourth slit, and to set the second carriage home position based on the position where the fourth slit was detected;

wherein the first scale and the second scale are disposed so that the end of the first scale to which the second slit is disposed, and the end of the second scale to which the fourth slit is disposed, are at the same end on opposite sides of the conveyance path.

2. The media processing device described in claim 1, wherein:

the first conveyance unit has a first stepper motor, and the control unit detects conveyance errors of the first conveyance unit based on a first number of steps the first stepper motor was driven, and the distance the first carriage moved, which is obtained based on detection of first slits by the first detection unit; and the second conveyance unit has a second stepper motor, and the control unit detects conveyance errors of the second conveyance unit based on a second number of steps the second stepper motor was driven, and the distance the second carriage moved, which is obtained based on detection of third slits by the second detection unit.

3. The media processing device described in claim 1, wherein:

the control unit does not detect conveyance errors when the first carriage or second carriage accelerates or decelerates.

4. The media processing device described in claim 1, wherein the first slits of the first scale and the third slits of the second scale are the same width; and the second slit of the first scale and the fourth slit of the second scale are the same width.

5. The media processing device described in claim 1, wherein the control unit supplies power to the first detection unit or second detection unit only when the first conveyance unit or the second conveyance unit is driven.

6. The media processing device described in claim 1, wherein the first specific distance is a distance greater than at least the sum of the first slit width, second slit width, and the gap between the first slit and second slit; and the second specific distance is a distance greater than at least the sum of the third slit width, fourth slit width, and the gap between the third slit and fourth slit.

7. A control method for a media processing device including a conveyance path that conveys a recording medium, on one side of the conveyance path a first recording head that records on one side of the recording medium, a first carriage that carries the first recording head, a first conveyance unit that moves the first carriage on a first carriage shaft, a first scale having a plurality of first slits of a specific width formed with a specific interval therebetween, and at one end thereof a second slit of a different width than the first slit, and a first detection unit that is carried on the first carriage and detects the first slits and the second slit of the first scale, and on the other side of the conveyance path a second recording head that records on the other side of the recording medium, a second carriage that carries the second recording head, a second conveyance unit that moves the second carriage on a second carriage shaft, a second scale having a plurality of third slits of a specific width formed with a specific interval therebetween, and at one end thereof a fourth slit of a different width than the third slit, and a second detection unit that is carried on the second carriage and detects the third slits and the fourth slit of the second scale, wherein the first scale and the second scale are disposed so that the end of the first scale to which the second slit is disposed, and the end of the second scale to which the fourth slit is disposed, are at the same end on opposite sides of the conveyance path, the control method comprising:

moving the first carriage a first specific distance away from the one end of the first scale, reversing and moving the first carriage at least until the first detection unit detects the second slit, and setting the first carriage home position based on the position where the second slit was detected, by the first conveyance unit; and moving the second carriage a second specific distance away from the one end of the second scale, reversing and moving the second carriage at least until the second detection unit detects the fourth slit, and setting the second carriage home position based on the position where the fourth slit was detected, by the second conveyance unit.

8. The control method for a media processing device described in claim 7, comprising further steps of:

detecting conveyance errors of the first conveyance unit based on a first number of steps a first stepper motor of the first conveyance unit was driven, and the distance the first carriage moved, which is obtained based on detection of first slits by the first detection unit; and detecting conveyance errors of the second conveyance unit based on a second number of steps a second stepper motor of the second conveyance unit was driven, and the distance the second carriage moved, which is obtained based on detection of third slits by the second detection unit.

9. The control method for a media processing device described in claim 8, wherein conveyance errors are not detected when the first carriage or second carriage accelerates or decelerates.

10. The control method for a media processing device described in claim 7, wherein the first slits of the first scale and the third slits of the second scale are the same width; and the second slit of the first scale and the fourth slit of the second scale are the same width.

11. The control method for a media processing device described in claim 7, wherein the control unit supplies power to the first detection unit or second detection unit only when the first conveyance unit or the second conveyance unit is driven.

12. The control method for a media processing device described in claim 7, wherein the first specific distance is a distance greater than at least the sum of the first slit width, second slit width, and the gap between the first slit and second slit; and the second specific distance is a distance greater than at least the sum of the third slit width, fourth slit width, and the gap between the third slit and fourth slit.

13. The control method for a media processing device described in claim 7, wherein the recording medium is a check on which magnetic ink characters are recorded;

a reading unit is disposed to the conveyance path to read magnetic ink characters from checks;

the first recording head is disposed to the conveyance path on the opposite side as the reading unit, and based on the home position of the first carriage records on the side of the check on which magnetic ink characters are not recorded; and the second recording head is disposed to the conveyance path on the same side as the reading unit, and based on the home position of the second carriage records on the side of the check on which magnetic ink characters are recorded.

14. A non-transitory computer readable storage medium storing a program executed by a control unit that controls parts of a media processing device including a conveyance path that conveys a recording medium, on one side of the conveyance path a first recording head that records on one side of the recording medium, a first carriage that carries the first recording head, a first conveyance unit that moves the first carriage on a first carriage shaft, a first scale having a plurality of first slits of a specific width formed with a specific interval therebetween, and at one end thereof a second slit of a different width than the first slit, and a first detection unit that is carried on the first carriage and detects the first slits and the second slit of the first scale, and on the other side of the conveyance path a second recording head that records on the other side of the recording medium, a second carriage that carries the second recording head, a second conveyance unit that moves the second carriage on a second carriage shaft, a second scale having a plurality of third slits of a specific width formed with a specific interval therebetween, and at one end thereof a fourth slit of a different width than the third slit, and a second detection unit that is carried on the second carriage and detects the third slits and the fourth slit of the second scale, wherein the first scale and the second scale are disposed so that the end of the first scale to which the second slit is disposed, and the end of the second scale to which the fourth slit is disposed, are at the same end on opposite sides of the conveyance path, the program comprising steps of:

moving the first carriage a first specific distance away from the one end of the first scale, reversing and moving the first carriage at least until the first detection unit detects the second slit, and setting the first carriage home position based on the position where the second slit was detected, by the first conveyance unit; and moving the second carriage a second specific distance away from the one end of the second scale, reversing and moving the second carriage at least until the second detection unit detects the fourth slit, and setting the second carriage home position based on the position where the fourth slit was detected, by the second conveyance unit.

* * * * *